United States Patent [19]

Kopinga et al.

[11] Patent Number: 4,527,017

[45] Date of Patent: Jul. 2, 1985

[54] MAGNET SYSTEM FOR AN ELECTROACOUSTIC TRANSDUCER

[75] Inventors: Wiert Kopinga; Herbert Mimmel, both of Eindhoven, Netherlands

[73] Assignee: U.S. Philips Corporation, New York, N.Y.

[21] Appl. No.: 200,668

[22] Filed: Oct. 27, 1980

[30] Foreign Application Priority Data

Nov. 20, 1979 [NL] Netherlands ..... 7908447

[51] Int. Cl.[3] ..... H04R 9/02

[52] U.S. Cl. ..... 179/115.5 PV

[58] Field of Search ..... 179/115.5 PV

[56] References Cited

U.S. PATENT DOCUMENTS 3,013,905 12/1961 Gamzon et al. ..... 179/115.5 PV

FOREIGN PATENT DOCUMENTS 1156815 5/1958 France .

52-38915 3/1977 Japan ..... 179/115.5 PV 6700284 7/1968 Netherlands .

*Primary Examiner*—George G. Stellar

*Attorney, Agent, or Firm*—Robert T. Mayer; Bernard Franzblau

[57] ABSTRACT

An electroacoustic transducer comprising a diaphragm provided with conductors and a magnet system having permanent magnetic zones at both sides of the diaphragm for producing an energizing field at the location of the conductors. At the boundary areas of the magnetic zones auxiliary magnetic fields are produced in order to reduce stray fields at the location of the boundary areas. This results in a better concentration of the energizing magnetic fields in the plane of the diaphragm so that a stronger magnetic field is obtained at the location of the conductors.

10 Claims, 4 Drawing Figures

PHN 9628

MAGNET SYSTEM FOR AN ELECTROACOUSTIC TRANSDUCER

The invention relates to an electroacoustic transducer comprising a diaphragm having conductors on at least one side and a magnet system on at least one side of the diaphragm for defining a plurality of adjacent magnetic zones. The adjacent magnetic zones have substantially opposed directions of magnetization and are positioned relative to the conductors on the diaphragm so that at the location of the conductors energizing magnetic fields are produced which extend substantially parallel to the diaphragm plane and transversely of the longitudinal direction of the conductors at this location. Such a transducer is known from U.S. Pat. No. 3,922,504. In the transducer revealed in this patent there are provided magnetic zones on both sides of the diaphragm, which zones are formed by adjacent magnets with opposite directions of magnetization. Facing magnets at both sides of the diaphragm also have opposite directions of magnetization. Through cooperation of the energizing magnetic fields at the location of the diaphragm, which fields are produced by the magnet system, and the signal current flowing in the conductors, a deflection of the diaphragm is produced in a direction perpendicular to the diaphragm surface thereby converting electric signals into acoustic energy.

It has been found that transducers of this type have a low efficiency so that large signal currents are necessary in order to obtain an acceptable acoustic output. This means that amplifiers of high power are required for driving the known transducers, while moreover a substantial amount of heat may be developed in the conductors.

It is an object of the invention to provide a transducer having a substantially higher efficiency. To this end the electro-acoustic transducer according to the invention is characterized in that the magnet system comprises further magnetizing means for the generation of auxiliary magnetic fields at the location of the boundary areas of the magnetic zones, which auxiliary magnetic fields have a direction of magnetization which is substantially opposed to the direction of the energizing magnetic field at the location of the nearest conductors.

The invention is based on the recognition that as a result of the short distance between adjacent—and, as the case may be, facing—magnetic zones with opposite directions of magnetization, a larger stray flux is produced in the magnetic material of the magnetic zones, especially at the diaphragm side, so that the magnetic field at the location of the diaphragm surface and the conductors remains small. By generating auxiliary magnetic fields, in accordance with the invention, at the location of the boundary areas of the magnetic zones with a direction of magnetization opposed to that of the normally existing stray flux, the energizing magnetic fields become more concentrated in the plane of the diaphragm, which results in an increased magnetic field at the location of the conductors.

A first embodiment of the electroacoustic transducer in accordance with the invention is characterized in that the magnetizing means are constituted by auxiliary magnets at the location of the boundary areas and in the vicinity of the diaphragm. These auxiliary magnets have a direction of magnetization which is substantially opposed to the direction of the energizing magnetic field at the location of the nearest conductor. The coercive field strength of the magnetic induction of the auxiliary magnets is at least equal to that of the magnetic zones.

This embodiment has the advantage that complete freedom is maintained with respect to the choice of the magnet material for the auxiliary magnets, for example, in view of the magnitude of the desired coercive force. Moreover, the size and the shape of the auxiliary magnets may be selected at option.

A second embodiment of the electroacoustic transducer in accordance with the invention is characterized in that the auxiliary magnetic fields are obtained by the use of magnetic zones which at the location of the boundary areas have a direction of magnetization which is substantially opposite to the direction of the energizing magnetic field at the location of the nearest conductor. This embodiment has the advantage that no separate auxiliary magnets need be used for obtaining the auxiliary magnetic fields. Moreover, this embodiment is highly suitable for the direct formation of the magnetic zones from a slab of a magnetic material.

A preferred embodiment of the electroacoustic transducer in accordance with the invention is characterized in that the auxiliary magnets are formed by an anisotropic magnetic material having a preferential direction of magnetization, the preferential direction of magnetization at any location in the magnetic material corresponding to the direction of magnetization at this location.

A further preferred embodiment of the electroacoustic transducer in accordance with the invention is characterized in that the magnetic zones are constituted by an anisotropic magnetic material having a preferential direction of magnetization, the preferential direction of magnetization at any location in the magnetic material corresponding to the direction of magnetization at this location. In the said preferred embodiments the interaction of adjacent magnetic zones and the auxiliary magnets is reduced, which yields an additional reduction of the stray fields. Moreover, this results in magnets with improved magnetic properties.

The invention will now be described in more detail with reference to the drawing in which.

Figure 1:
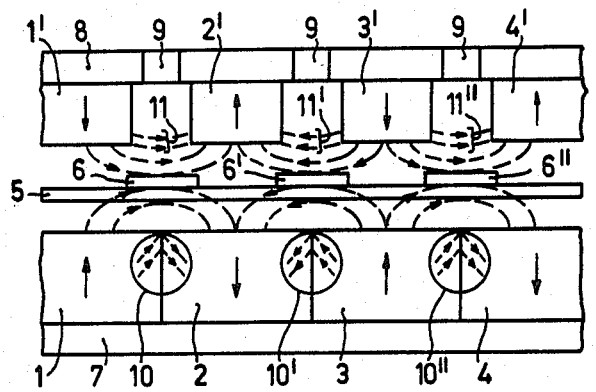
FIG. 1 shows a part of the known electroacoustic transducer.

FIG. 1 is a cross-sectional view of a part of the known transducer. This transducer comprises a diaphragm 5 on which conductors 6, 6' and 6'' are arranged. For the generation of energizing magnetic fields at the location of the diaphragm there is provided a magnet system, which defines magnetic zones at both sides of the diaphragm. At the lower side of the diaphragm there are disposed magnetic zones 1, 2, 3 and 4 comprising magnets placed against each other and having opposite directions of magnetization as indicated by the arrows. At the upper side of the diaphragm there are provided magnetic zones 1', 2', 3' and 4' comprising magnets which are spaced from each other and which also have opposed directions of magnetization, as is indicated by the arrows. Facing magnets at both sides of the diaphragm, 1, 1'; 2, 2'; 3, 3' and 4, 4' are also oppositely magnetized. The two rows of magnets 1, 2, 3, 4 and 1', 2', 3', 4' respectively are each provided with a soft-iron closing plate 7 and 8 respectively. The soft-iron closing plate 8 is formed with openings 9 through which the acoustic signal radiated by the vibrating diaphragm can reach the surrounding medium. At the location of the conductor 6 the combination of the magnets 1, 1' and 2, 2' produces an energizing magnetic field parallel to the diaphragm plane and extending transversely of the conductor 6, represented by the dashed lines. The same applies to the conductors 6' and 6'' owing to the combination of the magnets 2, 2' and 3, 3' and the combination 3, 3' and 4, 4' respectively. By selecting equally directed signal currents in the conductors 6 and 6'' and directed oppositely to that in the conductor 6', while the directions of the magnetic fields at the location of the two conductors 6 and 6'' are also equal and opposite to that at the location of the conductor 6', the diaphragm will deflect in the same direction at the location of the conductors. The resulting motion of the complete diaphragm will therefore be in phase.

Figure 2:
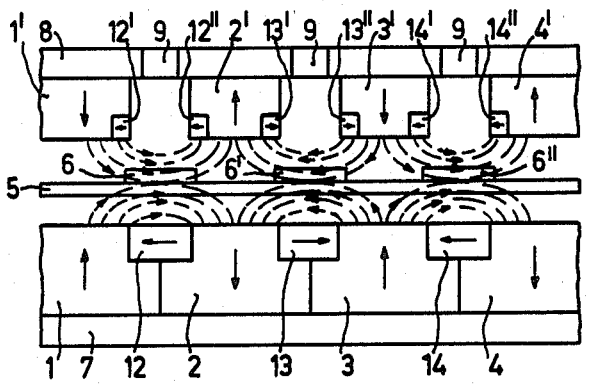
FIG. 2 shows a first embodiment of the electroacoustic transducer in accordance with the invention.

FIG. 2 shows a first embodiment of the transducer in accordance with the invention, corresponding elements in FIGS. 1 and 2 bearing the same reference numerals. The arrangement of the magnetic zones relative to the diaphragm and conductors is identical to that in FIG. 1. In accordance with the invention auxiliary magnets 12, 13 and 14 are arranged at the location of the boundary areas between the magnetic zones 1, 2; 2, 3 and 3, 4 respectively. At the location of the boundary areas of the magnetic zones 1', 2', 3' and 4' auxiliary magnets 12', 12'', 13'; 13'', 14' and 14'' respectively are situated. The directions of magnetization of the auxiliary magnets are indicated in FIG. 2 and are parallel to the diaphragm plane in a direction opposite to the energizing magnetic field at the location of the nearest conductors 6, 6' and 6'' respectively. By providing the auxiliary magnets the stray flux which normally exists between the magnetic zones, designated by the reference numerals 10, 10', 10'' and 11, 11', 11'' is largely eliminated. Since the directions of magnetization of the auxiliary magnets have been selected to be opposite to those of the normally existing stray fluxes, a better concentration of the energizing magnetic fields in the plane of the diaphragm is obtained, which results in an increased magnetic field at the location of the conductors. The improved magnetic field at the location of the diaphragm is represented by a greater density of the dashed lines representing the magnetic field.

This yields a transducer having a substantially higher efficiency. The additional magnets 12, 13, 14 and 12', 12'', 13', 13'', 14', 14'' respectively may extend to the closing plates 7 and 8 respectively. The coercive field strength of the additional magnets should at least be equal to that of the magnets already present 1, 2, 3, 4 and 1', 2', 3', 4' respectively, in order to ensure that the stray fluxes are fully eliminated.

Figure 3:
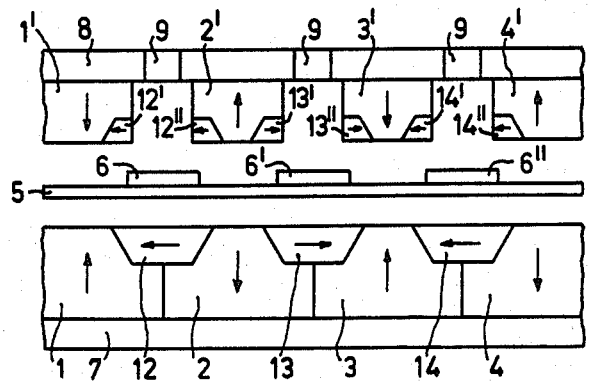
FIG. 3 shows a second embodiment of the electroacoustic transducer in accordance with the invention.

FIG. 3 shows a transducer in accordance with the invention, the auxiliary magnets having substantially wedge-shaped or trapezoidal cross-sections. Of course, it is also possible to employ auxiliary magnets of a different shape.

Figure 4:
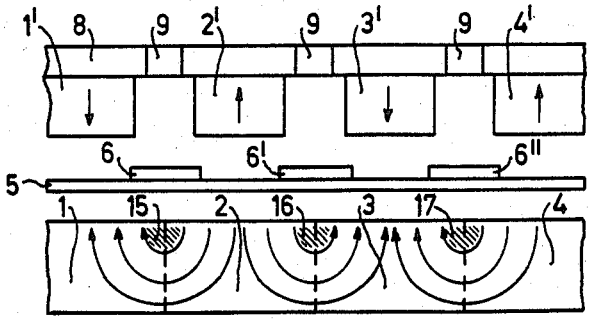
FIG. 4 shows a third embodiment of the electroacoustic transducer in accordance with the invention.

FIG. 4 shows a transducer in accordance with the invention in which no separate auxiliary magnets are used in order to obtain the auxiliary magnetic fields. The auxiliary magnetic fields at the boundary areas of the magnetic zones 1, 2, 3, 4 in this embodiment are obtained by magnetizing the magnetic zones, 1, 2, 3 and 4 in such a way that the directions of magnetization extend substantially perpendicular to the diaphragm plane but are parallel to the diaphragm plane at the location of the boundary areas represented by the dashed lines. As a result of this the stray fields at the location of the hatched areas 15, 16 and 17 remain small. The stray fields may be reduced even further by arranging auxiliary magnets at the locations 15, 16 and 17, in a similar way, to that shown in FIGS. 2 and 3 (auxiliary magnets 12, 13 and 14). The magnet system comprising the magnetic zones 1, 2, 3 and 4 may be constituted by separate magnets corresponding to the said magnetic zones, the boundary areas corresponding to the end faces of the magnets. However, it is alternatively possible to employ magnets with a horseshoe-shaped magnetization, whose end faces then correspond to the centre plane between the boundary areas of the magnetic zones 1, 2, 3, 4. The magnetic zones 1, 2, 3 and 4 may alternatively be constituted by a single slab of a magnetic material with a direction of magnetization as shown in FIG. 4.

The transducer of FIG. 4 has the additional advantage that a closing plate for the magnetic zones 1, 2, 3 and 4 may be dispensed with. The magnetic zones 1', 2', 3', 4' at the other side of the diaphragm have no auxiliary magnetic fields in the embodiment of FIG. 4. For these magnetic zones it is also possible to use one or a combination of the said steps. Finally, it is to be preferred in all the embodiments shown to use an anisotropic magnetic material with a preferential direction of magnetization having the same orientation as the direction of magnetization. This is to be understood to mean that at any location in the magnetic material, before this material is magnetized in accordance with the pattern shown in FIGS. 2, 3 and in particular FIG. 4, the material already has a preferred orientation which corresponds to the direction of magnetization at said location after the material has been magnetized. This reduces the interaction between adjacent magnetic zones. Moreover, the magnetic properties of the magnets are improved.

It is to be noted that although the invention has been described for transducers having magnetic zones at both sides of the diaphragm, the invention is also applicable to transducers where the magnetic zones are arranged at one side of the diaphragm only. Obviously, the invention is by no means limited to the embodiments shown in the Figures, different shapes of the magnetic zones or the auxiliary magnets being also applicable. Furthermore, the invention is not limited to transducers with straight conductors or magnets, but is equally applicable to transducers with conductors which are for example arranged in the diaphragm in accordance with a spiral shape.

What is claimed is:

1. An electroacoustic transducer comprising a diaphragm having at least one surface which is provided with conductors, a magnet system located on at least one side of the diaphragm and defining a plurality of adjacent permanent magnetic zones, with any two adjacent zones having substantially opposed directions of magnetization and positioned relative to the conductors on the diaphragm so that at the location of the conductors energizing magnetic fields are produced which extend substantially parallel to the diaphragm surface and transversely of the longitudinal direction of the conductors at said location, and wherein the magnetic system further comprises magnetizing means for the generation of auxiliary magnetic fields at the location of boundary areas between the said permanent magnetic zones, said auxiliary magnetic fields having a direction of magnetization which is substantially opposed to the direction of the energizing magnetic field at the location of the nearest conductor.

2. An electroacoustic transducer as claimed in claim 1 wherein the magnetizing means comprise auxiliary magnets at the location of the boundary areas in the vicinity of the diaphragm, said auxiliary magnets having a direction of magnetization which is substantially opposed to the direction of the energizing magnetic field at the location of the nearest conductor, the coercive field strength of the magnetic induction of the auxiliary magnets being at least equal to that of the magnetic zones.

3. An electroacoustic transducer as claimed in claim 2, wherein the auxiliary magnets are formed by an anisotropic magnetic material having a preferential direction of magnetization, the preferential direction of magnetization at any location in the magnetic material corresponding to the direction of magnetization at said location.

4. An electroacoustic transducer as claimed in claim 1, wherein said adjacent magnetic zones are alternately magnetized in opposite directions perpendicular to the plane of the diaphragm and said magnetizing means comprise auxiliary magnets located at the boundary areas proximate the diaphragm and alternately magnetized in opposite directions substantially parallel to the plane of the diaphragm thereby to reduce stray magnetic fields that otherwise occur in the vicinity of said proximate boundary areas.

5. An electroacoustic transducer as claimed in claim 4 wherein said auxiliary magnets have a substantially trapezoidal cross-section.

6. An electroacoustic transducer comprising a vibratile diaphragm having a series of conductors on at least one surface thereof, a magnet system located on at least one side of the diaphragm and comprising a plurality of adjacent permanent magnetic zones having substantially opposed directions of magnetization at a surface thereof adjacent the diaphragm, said directions of magnetization being perpendicular to the plane of the diaphragm so that an energizing magnetic field is produced at the conductors which extend substantially parallel to the diaphragm surface and transverse to the longitudinal axes of the conductors, said magnetic zones being magnetized so that at the boundary areas between adjacent magnetic zones and proximate said adjacent surface of the magnet system the direction of magnetization extends approximately parallel to the diaphragm plane so as to produce auxiliary magnetic fields at said proximate boundary areas which have a direction of magnetization substantially opposed to the direction of the energizing magnetic field at the location of the nearest conductor.

7. An electroacoustic transducer as claimed in claims 1 or 6 wherein the magnetic zones comprise an anisotropic magnetic material having a preferential direction of magnetization, the preferential direction of magnetization at any location in the magnetic material corresponding to the direction of magnetization at said location.

8. An electroacoustic transducer as claimed in claims 1 or 6 wherein the magnet system also includes a second plurality of adjacent permanent magnetic zones on the other side of the diaphragm similar to those on said one side of the diaphragm and the magnetizing means also produce auxiliary magnetic fields at said other side of the diaphragm extending in directions opposed to the directions of energizing magnetic fields at the nearest conductors and produced by said second plurality of permanent magnetic zones.

9. An electroacoustic transducer comprising a vibratile diaphragm having a plurality of parallel conductors on at least one surface thereof, a magnet system positioned to one side of the diaphragm and comprising a plurality of adjacent permanent magnetic zones having substantially opposed directions of magnetization perpendicular to the plane of the diaphragm so that an energizing magnetic field is produced at the conductors which extends substantially parallel to the diaphragm surface and transverse to the longitudinal axes of the conductors, and magnetizing means for producing auxiliary magnetic fields at boundary areas between said adjacent permanent magnetic zones in a direction approximately parallel to the opposite to the energizing magnetic field at the nearest conductor on the diaphragm.

10. An electroacoustic transducer as claimed in claim 9 wherein said magnetizing means comprise auxiliary magnets located at the boundary areas proximate the diaphragm and alternately magnetized in opposite directions substantially parallel to the plane of the diaphragm thereby to reduce stray magnetic fields in the vicinity of said proximate boundary areas.

* * * * *

UNITED STATES PATENT AND TRADEMARK OFFICE

CERTIFICATE OF CORRECTION

PATENT NO. : 4,527,017

DATED : July 2, 1985

INVENTOR(S) : WIERT KOPINGA ET AL

It is certified that error appears in the above-identified patent and that said Letters Patent is hereby corrected as shown below:

IN THE CLAIMS

Claim 9, line 14, change "the" (first occurence) to --and--.

Signed and Sealed this

Sixth Day of January, 1987

*Attest:*

DONALD J. QUIGG

*Attesting Officer*

*Commissioner of Patents and Trademarks*